US005642335A

United States Patent [19]

Taylor

[11] Patent Number: 5,642,335

[45] Date of Patent: Jun. 24, 1997

[54] CLOCK

[76] Inventor: Raymond R. Taylor, 2840 Lera Jones Dr., Antioch, Tenn. 37013

[21] Appl. No.: 529,676

[22] Filed: Sep. 18, 1995

[51] Int. Cl.[6] ..... G04B 19/00; G04B 19/04

[52] U.S. Cl. ..... 368/223; 368/228

[58] Field of Search ..... 368/76, 80, 223, 368/228, 232

[56] References Cited

U.S. PATENT DOCUMENTS

| | | | |
|---|---|---|---|
| 903,964 | 1/1908 | Ferguson | 368/232 |
| 1,370,401 | 3/1921 | Becker | 368/232 |
| 1,517,174 | 11/1924 | Schmidt | 368/228 |
| 2,564,270 | 8/1951 | McMillen | 368/228 |
| 5,030,104 | 7/1991 | Caldwell | 368/228 |
| 5,422,864 | 6/1995 | Lorello | 368/223 |

OTHER PUBLICATIONS

Crayola Home Helping Hands Quartz Wall Clock (photograph), by Spartus Home Furnishings.

*Primary Examiner*—Vit W. Miska

*Attorney, Agent, or Firm*—Waddey & Patterson; Laura K. Thomas

[57] ABSTRACT

A clock useful for instruction in how to read time comprising a face and two sets of numbers, the first set including integers one through twelve and the second set including integers zero through fifty-nine, positioned about the face and contained within differently colored bands first and second distances, respectively, from a center point of the face. The clock includes an hour hand colored the same as the first band and a minute hand colored the same as the second band rotatably attached to the face at the center point and extending to the first and second sets of numbers, respectively, the minute hand being longer than the hour hand. The face is divided into twelve equally sized segments, each of which is further divided into five equally sized sub-segments, beginning at the top center of the face and proceeding in a clockwise direction. The first segment contains the integer one from the first set of numbers, and the remaining numbers in the first set are arranged consecutively in a clockwise direction about the face. The first sub-segment contains the integer zero from the second set of numbers, and the remaining numbers in the second set are arranged consecutively in a clockwise direction. The clock combines the features of analog and digital clocks and allows a person to read the actual time as soon as he or she can recognize numbers and grasp the "passage of time concept" by observing the movement of hands about the face.

14 Claims, 3 Drawing Sheets

CLOCK

BACKGROUND OF INVENTION

1. Field of the Invention

The present invention relates generally to clocks, but more particularly to clocks useful for instruction in how to read time.

2. Description of the Related Art

Time is the means by which we measure duration and mark the occurrence of events. The incremental measurement of time provides a basis for the concepts of past, present and future, and provides a frame of reference about which we order our existence. The accurate measurement of an interval of time requires a regularly repeating occurrence or phenomenon against which it can be compared, such as the alteration of light and dark which comprises a day.

Measuring the passage of time and reading time are two separate aspects of the general concept of time. An analog clock having hands that move at a regular pace to measure minute and hour intervals is perhaps the most common device used for both measuring the passage of time and for reading time. The typical analog clock includes a face having the integers one through twelve equally spaced and arranged consecutively about the perimeter of the face. The face may also include further markings to visually indicate the minute intervals. A minute hand and an hour hand attached at the center of the face move around in a circular fashion and point to numbers which indicate the time. It is believed that a digital clock, while useful for reading the time, does not facilitate the understanding of or the visual observance of the passage of time.

Time can be a difficult concept for children to understand, and learning to tell time and to read time may prove to be a formidable task. Any type of visual aid that allows a child to make familiar associations in learning how time is measured and read quickly becomes an essential teaching tool. It is believed that, in school, a six-year-old is only taught to tell time by the quarter-hour. The clock of the present invention, however, allows a child to observe the passage of time and to read the exact time as soon as he or she able to recognize numbers, usually at the age of four years. Also, because children respond visually to colors at a very early age, the clock of the present invention may incorporate coordinated colors to further facilitate the learning process.

In teaching children how to tell time, it is difficult to convey the concept that as the hour hand moves from one number to the next, corresponding to the passage of one hour, the minute hand completes one entire revolution about the face of the clock, also corresponding to one hour or sixty minutes. It is also difficult to teach children to actually read the time by observing the position of the hour and minute hand on the face of the clock. There are no visual indications on the face to convey the concept that the one o'clock hour, for example, includes all readings of time when the hour hand is positioned between the one and the two on the clock face. Moreover, there are no indications on the face which allow one to make a direct reading of the time by observing the exact position of the hands on the face of the clock relative to numbers corresponding to the time.

The art to which the present invention pertains includes a clock manufactured by Spartan comprising a circular face having the integers one to twelve positioned radially about the perimeter as on a conventional clock, the integers one to sixty positioned radially about the face adjacent the integers one to twelve, the words one to twelve contained within a segmented band positioned radially about the face adjacent the integers one to sixty, an hour hand resembling a Crayola crayon attached to the face at its center point and extending to the numbers one through twelve, and a minute hand resembling a Crayola crayon attached to the face at its center point and extending to the numbers one through sixty. The hour and minute hands are different colors, and each segment of the band containing the words one to twelve is a different color.

The inventive clock combines the features of an analog clock and a digital clock in that it allows a person to read the actual time as soon as he or she is able to recognize numbers and to grasp the "passage of time" concept by observing the movement of hands about the face of the clock. Accordingly, a person can read the time, as if reading the display on a digital clock, by reading the numbers corresponding to the positions of the hour and minute hand. Also, a person can gain an understanding of the passage of time, as with a conventional analog clock, by observing the movements of the hands about the face of the clock corresponding to the passage of minutes or hours. Until now, it is believed that such a clock specifically designed for instruction in how to read time has not been invented.

SUMMARY OF THE INVENTION

The present invention is directed to a clock, particularly one that is useful for instruction in how to read time. The inventive clock includes a face having a top, two sets of numbers positioned radially about the face at first and second distances, respectively, from a center point on the face, an hour hand and a minute hand rotatably attached to the face at the center point and extending therefrom to the first and second sets of numbers, respectively. The second distance is further from the center point than the second distance, thus, the minute hand is longer than the hour hand. The first set of spaced apart numbers includes consecutive integers one through twelve, and the second set of spaced apart numbers includes consecutive integers zero through fifty-nine.

The face is divided into twelve equally sized segments extending radially from the center point and beginning along a line extending vertically from the center point of the face to a top center of the face, representing a zero degree line, and proceeding in a clockwise direction about the face. Accordingly, each of the twelve segments comprises an area defined by a thirty degree angle, and each segment contains one number from the first set of numbers. The segment defined by the area from zero degrees to thirty degrees contains the integer twelve. The segment defined by the area from thirty degrees to sixty degrees contains the integer one. The segment defined by the area from sixty degrees to ninety degrees contains the integer two, and so forth in a clockwise direction about the face. The last segment, defined by the area from three hundred thirty degrees to three hundred sixty degrees, contains the integer eleven.

A portion of each of the twelve segments is further divided into five smaller equally sized sub-segments comprising an area defined by a six degree angle. Each sub-segment contains one number from the second set of numbers. Beginning along the zero degree line extending from the center point of the face to the top center of the face, the sub-segment defined by the area from zero degrees to six degrees contains the integer zero. The sub-segment defined by the area from six degrees to twelve degrees contains the integer one, and so forth in a clockwise direction about the face. The integers zero through nine are preceded by a zero (for example, 00, 01, 02, etc.) so that a reading of time including any of the integers contained within these sub-segments would comport with convention, i.e. "twelve-o-one", "twelve-o-two", etc. The last sub-segment, defined by the area from three hundred fifty-four degrees to three hundred sixty degrees, contains the integer fifty-nine.

Thus, contained within the segment defined by the area from zero degrees to thirty degrees are the integer twelve from the first set of numbers and five smaller sub-segments containing the integers zero through five from the second set of numbers arranged consecutively in a clockwise direction from the zero degree line. Contained within the segment defined by the area from three hundred thirty degrees to three hundred sixty degrees are the integer eleven from the first set of numbers and five smaller sub-segments containing the integers fifty-five through fifty-nine from the second set of numbers arranged consecutively in a clockwise direction from the three hundred thirty degree point.

The word "o'clock" may be positioned along the zero degree line, preferably between the sub-segments containing the integers zero and fifty-nine.

The first and second sets of numbers may be contained within bands of different colors, and the hour and minute hands may be colored to correspond to the colors of the bands such that the hour hand is the same color as the band containing the first set of numbers, and the minute hand is the same color as the band containing the second set of numbers. In accordance with the configuration described above, the bands are divided into equally sized segments and sub-segments. One band contains a segment for each number in the first set of numbers, and another band contains a segment for each number in the second set of numbers. Accordingly, the band for the first set of numbers contains twelve equally sized segments, and the band for the second set of numbers contains sixty equally sized segments.

Adjacent colored blocks separated by a colon may also be positioned on the face of the clock, preferably such that the colon is positioned along the zero degree line with the adjacent blocks on either side of the colon. The block to the left of the colon is colored the same as the band containing the first set of numbers, and the block to the right of the colon is colored the same as the band containing the second set of numbers. By associating the colors of the band to the colors of the blocks, a person can observe that, when reading the time, the number read from the first set of numbers precedes the number read from the second set of numbers.

An alternative embodiment of the present invention includes a third set of numbers comprising consecutive integers one through twelve positioned radially about the face a third distance from the center point of the face. Each number of the third set of numbers is positioned at a point along one of the boundaries of the twelve previously defined segments. Accordingly, the integer twelve is positioned along the zero degree line extending from the center point of the face to the top center of the face. The integer one is positioned along a line thirty degrees from the zero degree line, the integer two is positioned along a line sixty degrees from the zero degree line, and so forth in a clockwise direction about the face.

The embodiments of the present invention may, therefore, be summarized in a variety of ways, one of which is the following: a clock useful for instruction in how to read time, comprising a face; two sets of numbers positioned radially about the face at first and second distances, respectively, from a center point of the face; an hour hand and a minute hand rotatably attached to the face at the center point and extending therefrom to the first and second sets of numbers, respectively, the minute hand being longer than the hour hand; the first set of numbers including consecutive integers one through twelve, and the second set of numbers including consecutive integers zero through fifty-nine; wherein the face is divided into twelve equally sized segments, each segment comprising an area defined by a thirty degree angle beginning along a line extending vertically from the center point of the face to a top of the face, representing a zero degree line, and proceeding in a clockwise direction about the face; wherein the segment defined by the area from thirty degrees to sixty degrees contains the integer one from the first set of numbers and the remaining numbers in the first set of numbers are arranged consecutively in a clockwise direction about the face; wherein a portion of each of the twelve segments is further divided into five equally sized sub-segments, each sub-segment comprising an area defined by a six degree angle beginning along the zero degree line and proceeding in a clockwise direction about the face; and wherein the sub-segment defined by the area from zero degrees to six degrees contains the integer zero from the second set of numbers and the remaining numbers in the second set of numbers are arranged consecutively in a clockwise direction about the face.

The first and second sets of numbers are contained within bands of different color. The hour hand is the same color as the band containing the first set of numbers, and the minute hand is the same color as the band containing the second set of numbers. Adjacent colored blocks separated by a colon are positioned on the face of the clock, preferably such that the colon is positioned along the zero degree line with the adjacent blocks on either side of the colon. The block to the left of the colon is colored the same as the hour hand and the band containing the first set of numbers, and the block to the right of the colon is colored the same as the minute hand and the band containing the second set of numbers. The word "o'clock" is positioned vertically along the zero degree line, preferably between the sub-segments containing the integers zero and fifty-nine.

The clock may include a third set of numbers comprising consecutive integers one through twelve positioned radially about the center of the face a third distance from the center point. Each number of the third set of numbers is positioned at a point along a boundary of one of the twelve segments. The integer twelve is positioned at the zero degree point, the integer one is positioned at the thirty degree point, and the remaining integers of the third set of numbers are arranged consecutively in a clockwise direction about the face at succeeding segment boundaries.

Yet another way of summarizing the invention is: a clock useful for instruction in how to read time, comprising a face; a first set of numbers including integers one through twelve contained within a first band having twelve equally-sized segments having adjacent boundaries; a second set of numbers including integers zero through fifty-nine contained within a second band having sixty equally-sized segments having adjacent boundaries; an hour hand rotatably attached to a center point of the face and extending therefrom a distance to a point within the first band; a minute hand rotatably attached to the face at the center point and extending therefrom a distance to a point within the second band; wherein the minute hand is longer than the hour hand, wherein a boundary of one of the segments of the first band and one of the segments of the second band lies along a line extending vertically from the center point of the face to a top of the face, wherein the segment of the first band proceeding in a clockwise direction from the line extending vertically from the center to the top of the face contains the integer twelve of the first set of numbers, and the succeeding segments in the first band each contain one of the remaining integers of the first set of numbers, arranged consecutively beginning with the integer one and proceeding in a clockwise direction about the face; wherein the segment of the second band proceeding in a clockwise direction from the line extending vertically from the center to the top of the face contains the integer zero of the second set of numbers, and the succeeding segments in the second band each contain one of the remaining integers of the second set of numbers, arranged consecutively and proceeding in a clockwise direction about the face.

A third way of summarizing the invention is: a clock, comprising a face; a first annulus positioned a first distance from a center point of the face and divided into twelve equally sized sectors beginning at a top center of the face and proceeding radially in a clockwise direction; a second annulus positioned a second distance from the center point of the face and divided into sixty equally sized sectors beginning at a top center of the face and proceeding radially in a clockwise direction; an hour hand and a minute hand rotatably attached at the center point of the face and extending to the first and second annuluses, respectively, the minute hand being longer than the hour hand; a first set of numbers including the integers one through twelve; a second set of numbers including the integers zero through fifty-nine, wherein the integers zero through nine of the second set of numbers are preceded by a zero; wherein each sector of the first annulus contains one number from the first set of numbers and each sector of the second annulus contains one number from the second set of numbers; wherein the sector of the first annulus extending radially in a clockwise direction from the top center of the face contains the number twelve from the first set of numbers, the next adjacent sector contains the number one from the first set of numbers, and the remaining sectors contain the remaining numbers from the first set of numbers arranged consecutively in a clockwise direction about the face; and wherein the sector of the second annulus extending radially in a clockwise direction from the top center of the face contains the number zero from the second set of numbers, the next adjacent sector contains the number one from the second set of numbers, and the remaining sectors contain the remaining numbers from the second set of numbers arranged consecutively in a clockwise direction about the face.

The first and second annuluses are colored differently. The hour hand is the same color as the first annulus, and the minute hand is the same color as the second annulus. Adjacent colored blocks separated by a colon are positioned on the face of the clock, preferably such that the colon is positioned along the line extending from the center of the face to the top center of the face, with the adjacent blocks on either side of the colon. The block to the left of the colon is colored the same as the first annulus and the hour hand, and the block to the right of the colon is colored the same as the second annulus and the minute hand. The word "o'clock" is positioned vertically along the line extending from the center of the face to the top center of the face, preferably between the sectors of the second annulus containing the integers zero and fifty-nine.

The clock may include a third set of numbers comprising consecutive integers one through twelve positioned radially a third distance from the center of the face; wherein each number of the third set of numbers is positioned at a point along a boundary line of one of the twelve sectors; and wherein the integer twelve is positioned along the boundary line extending vertically from the center to the top center of the face and, proceeding in a clockwise direction, the integer one is positioned along the boundary line of the next succeeding sector and the preceding sector, and the remaining integers of the third set of numbers are arranged consecutively in a clockwise direction about the face along succeeding boundary lines of the remaining sectors.

These and other features and advantages shall become apparent after consideration of the description and drawings set forth herein. All such features and advantages are contemplated to be within the scope of the present invention even though not specifically set forth herein.

DESCRIPTION OF THE PREFERRED EMBODIMENTS

Figure 1:
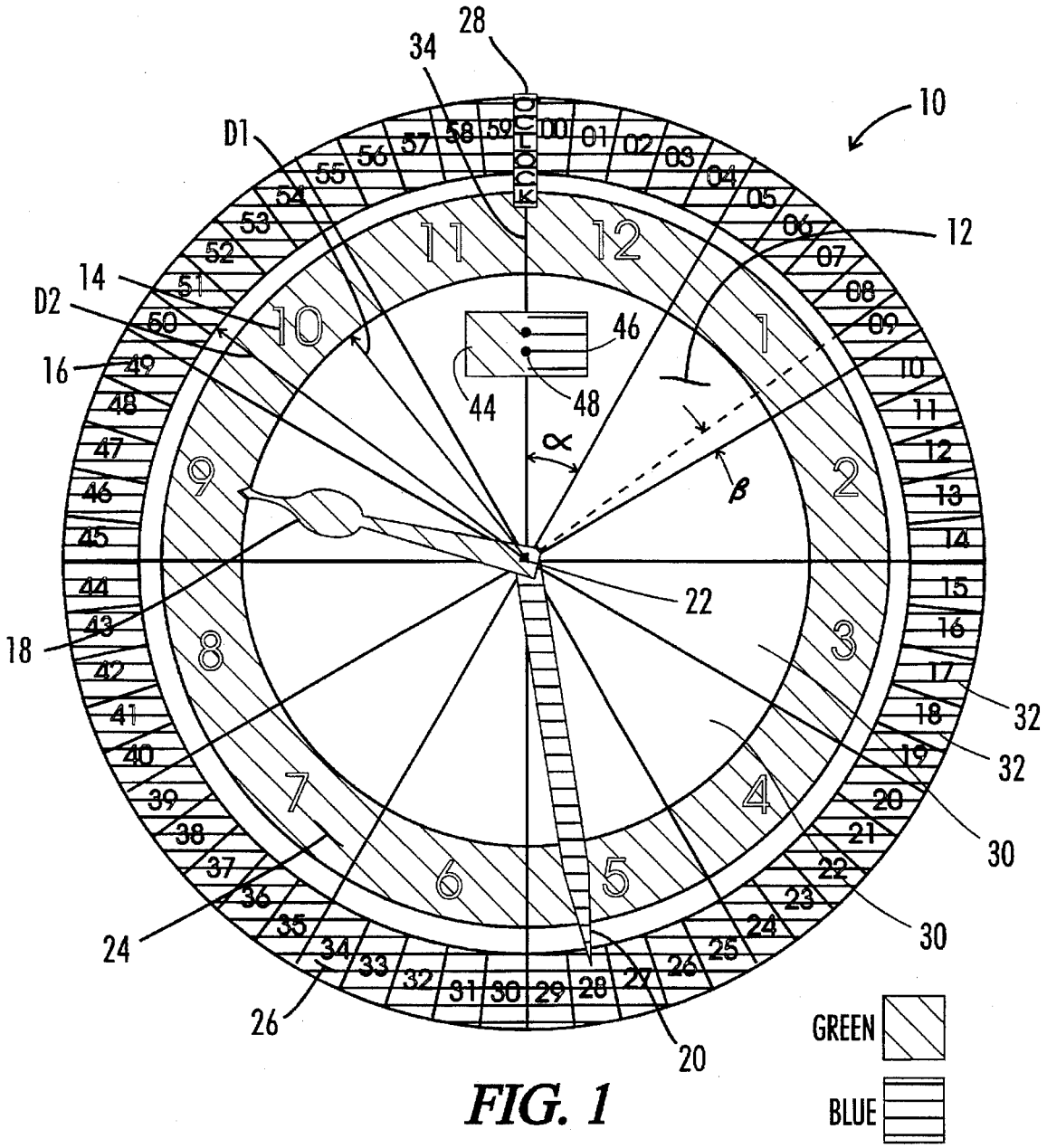
FIG. 1 is a front view of an embodiment of the present invention.

An embodiment of the present invention is designated generally by the reference numeral 10 in FIG. 1. Embodiment 10 includes a face 12 having a top 28 and two sets of numbers 14 and 16 positioned radially about the face 12 at first and second distances D1 and D2, respectively, from a center point 22 on the face 12. An hour hand 18 and a minute hand 20 are rotatably attached to the face 12 at the center point 22 and extend therefrom to the first and second sets of numbers 14 and 16, respectively. The second distance D2 is further away from the center point 22 of the face 12 than the first distance D1, thus, the minute hand is longer than the hour hand. The first set of numbers 14 includes consecutive integers one through twelve, and the second set of numbers 16 includes consecutive integers zero through fifty-nine. The integers zero through nine of the second set of numbers are preceded by a zero.

The face 12 is divided into twelve equally sized segments 30 beginning along a line 34 extending vertically from the center point 22 of the face 12 to the top 28 of the face, representing a zero degree line 34, and proceeding in a clockwise direction about the face. Accordingly, each of the twelve segments 30 comprises an area defined by a thirty degree angle alpha. Each segment 30 contains one number from the first set of numbers 14. The segment 30 defined by the area from the zero degrees to thirty degrees contains the integer twelve from the first set of numbers 14. The segment 30 defined by the area from thirty degrees to sixty degrees contains the integer one from the first set of numbers 14. The segment 30 defined by the area from sixty degrees to ninety degrees contains the integer two from the first set of numbers 14, and so forth in a clockwise direction about the face 12. The last segment 30, defined by the area from three hundred thirty degrees to three hundred sixty degrees, contains the integer eleven from the first set of numbers 14.

A portion of each of the twelve segments 30 is further divided into five equally sized sub-segments 32 comprising an area defined by a six degree angle beta. Each of the sixty sub-segments 32 contains one number from the second set of numbers 16. Beginning along the zero degree line 34, the sub-segment 32 defined by the area from zero degrees to six degrees contains the integer zero from the second set of numbers 16. The sub-segment 32 defined by the area from six degrees to twelve degrees contains the integer one from the second set of numbers 16, and so forth in a clockwise direction about the face 12. The last sub-segment 32, defined by the area from three hundred fifty-four degrees to three hundred sixty degrees, contains the integer fifty-nine from the second set of numbers 16.

Thus, in accordance with the configuration described above, contained within the first segment 30 defined by the area from zero degrees to thirty degrees are the integer twelve from the first set of numbers 14 and five smaller sub-segments 32 containing the integers zero through five from the second set of numbers 16 arranged consecutively in a clockwise direction from the zero degree point 34. Contained within the last segment 30 defined by the area from three hundred thirty degrees to three hundred sixty degrees are the integer eleven from the first set of numbers 14 and five smaller sub-segments 32 containing the integers fifty-five through fifty-nine from the second set of numbers 16 arranged consecutively in a clockwise direction from the three hundred thirty degree point 36.

The word "o'clock" may be positioned vertically along the zero degree line, preferably between the sub-segments containing the integers zero and fifty-nine.

The first and second sets of numbers 14 and 16 may be contained within bands 24 and 26 of different color, and the hour and minute hands 18 and 20 may be colored to correspond to the colors of the bands 24 and 26 such that the hour hand 18 is the same color as the band 24 containing the first set of numbers 14, and the minute hand 20 is the same color as the band 26 containing the second set of numbers 16. In accordance with the configuration described above, the bands 24 and 26 are divided into equally sized segments 30 and sub-segments 32, respectively. Thus, one band 24 contains a segment 30 for each number in the first set of numbers 14, and the other band 26 contains a sub-segment 32 for each number in the second set of numbers 16. Accordingly, the band 24 for the first set of numbers 14 contains twelve equally sized segments 30, and the band 26 for the second set of numbers 16 contains sixty equally sized sub-segments 32.

Adjacent colored blocks 44 and 46 separated by a colon 48 may be positioned on the face 12 of the clock, preferably such that the colon 48 is positioned along the zero degree line 34 with the adjacent blocks 44 and 46 on either side of the colon 48. The block 44 to the left of the colon 48 is colored the same as the band 24 containing the first set of numbers 14, and the block 46 to the right of the colon 48 is colored the same as the band 26 containing the second set of numbers 16.

Figure 2:
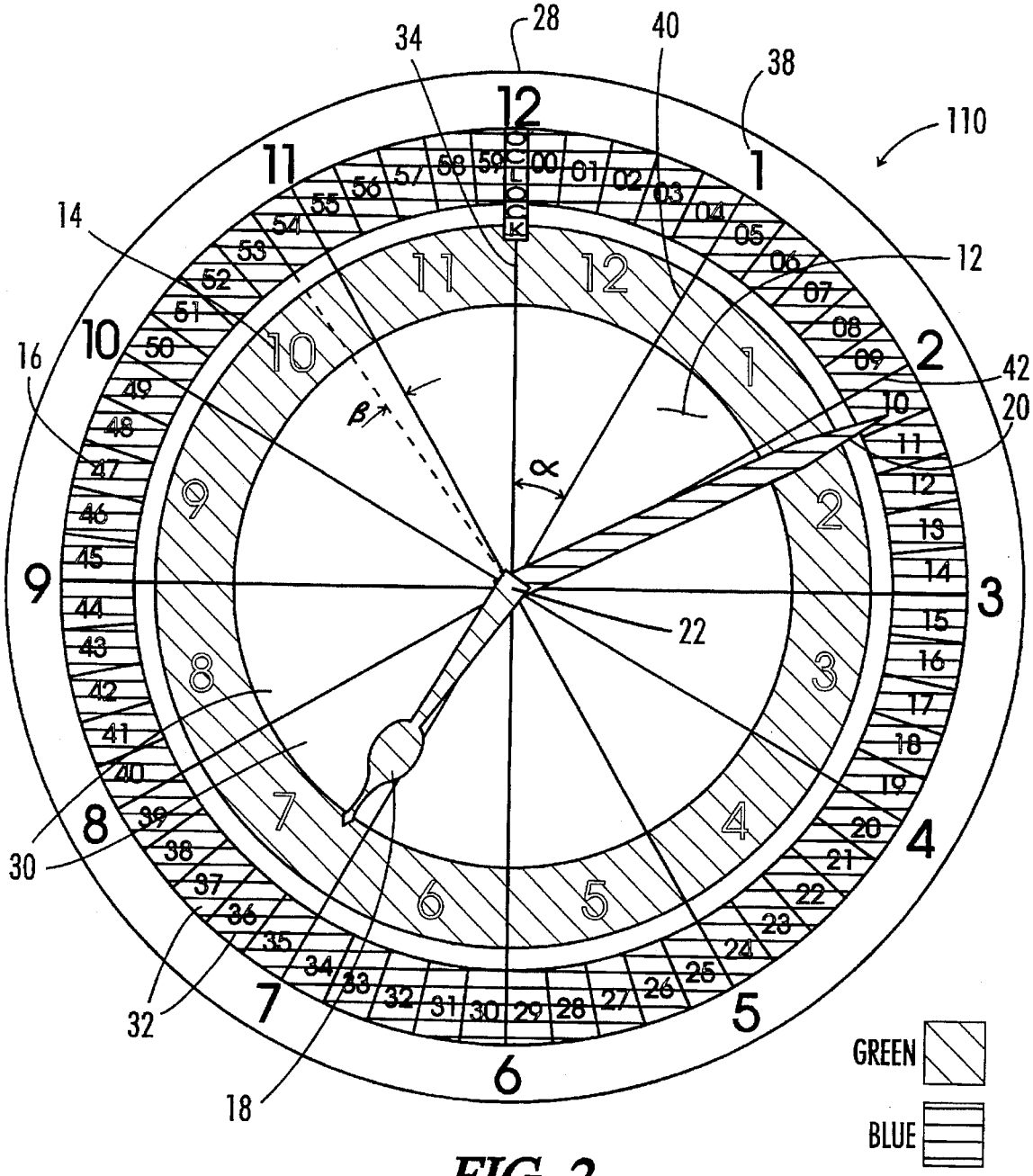
FIG. 2 is a front view of an alternate embodiment of the present invention.

An alternative embodiment of the present invention is designated generally by the reference numeral 110 in FIG. 2. Alternate embodiment 110 includes a third set of numbers 38 comprising consecutive integers one through twelve positioned radially about the center 22 of the face 12. The numbers of the third set of numbers 38 are positioned consecutively at points substantially along each of the lines defining the twelve segment boundaries, consistent with the arrangement of numbers on the face of a conventional clock. Accordingly, the integer twelve from the third set of numbers 38 is positioned along the zero degree line 34. The integer one from the third set of numbers 38 is positioned along the thirty degree line 40. The integer two is positioned along the sixty degree line 42, and so forth in a clockwise direction about the face 12.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected by the appended claims.

Figure 3:
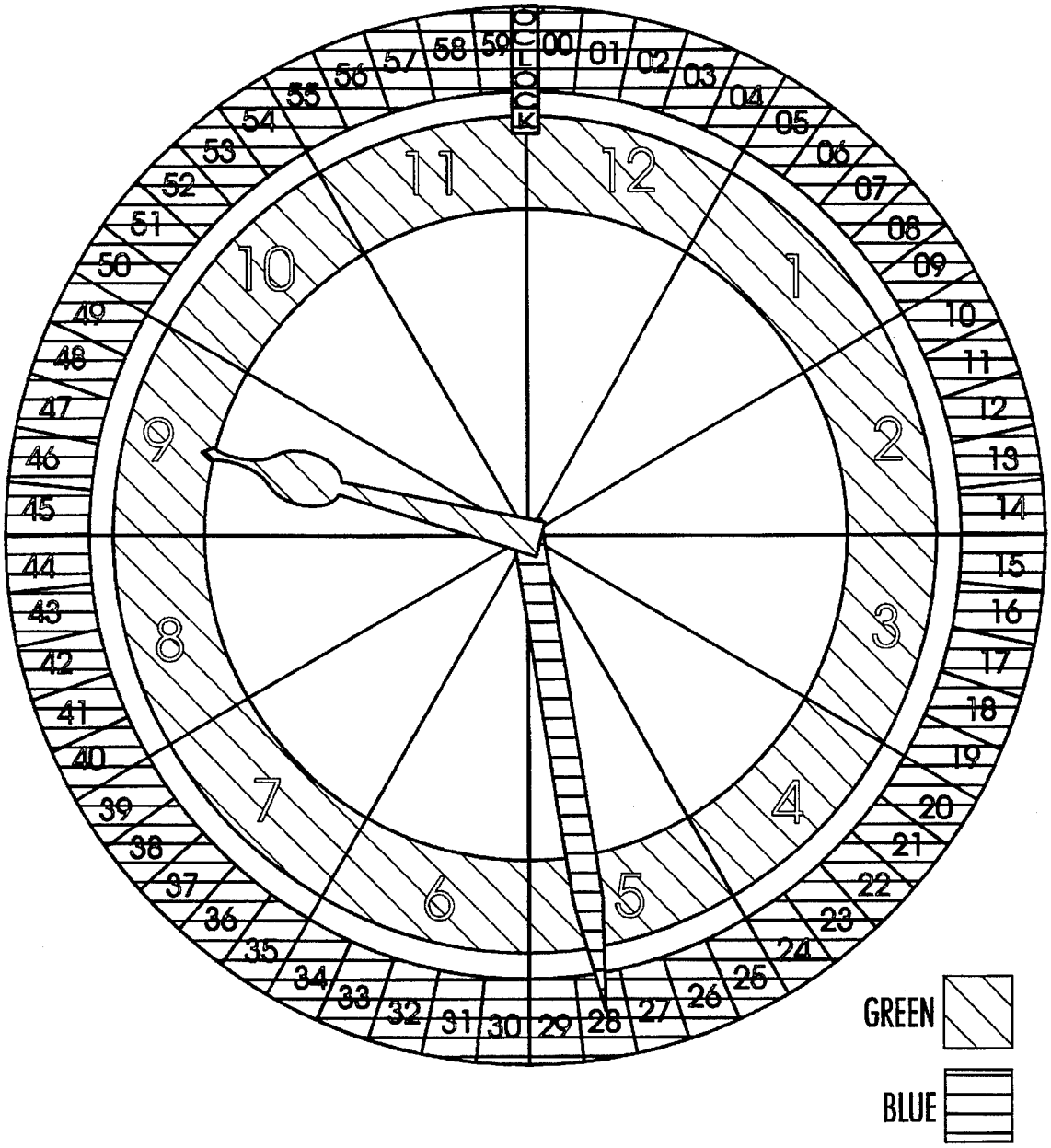
FIG. 3 is a front view of an embodiment of the present invention with reference numerals removed.

It is believed that the reference numerals and lead lines on the drawings submitted with Applicant's application, while necessary to fully disclose the invention, detract from the full visual effects of the Applicant's invention. Accordingly, FIG. 3 does not include reference numerals and enables a better appreciation of the visual effects of the Applicant's invention.

What is claimed is:

1. A clock useful for instruction in how to read time, comprising:

a face;

two sets of numbers positioned radially about the face at first and second distances, respectively, from a center point of the face, wherein the second distance is further away from the center point of the face than the first distance;

an hour hand and a minute hand attached to the face at the center point and extending therefrom to the first and second sets of numbers, respectively;

the first set of numbers including consecutive integers one through twelve, and the second set of numbers including consecutive integers zero zero through fifty-nine;

wherein the face is divided into twelve equally sized segments, each segment comprising an area defined by a thirty degree angle beginning along a line extending vertically from the center point of the face to a top of the face, representing a zero degree line, and proceeding in a clockwise direction about the face;

wherein the segment defined by the area from thirty degrees to sixty degrees contains the integer one from the first set of numbers and the remaining numbers in the first set of numbers are arranged consecutively in a clockwise direction about the face;

wherein a portion of each of the twelve segments is further divided into five equally sized sub-segments, each sub-segment comprising an area defined by a six degree angle beginning along the zero degree line and proceeding in a clockwise direction about the face;

wherein the sub-segment defined by the area from zero degrees to six degrees contains the integer zero zero from the second set of numbers and the remaining numbers in the second set of numbers are arranged consecutively in a clockwise direction about the face;

the hour hand is sized to have a length sufficient to extend from the center point into a first band containing the first set of numbers, and the hour hand and the first band are colored a first color;

the minute hand is sized to have a length sufficient to extend from the center point into a second band containing the second set of numbers, and the minute hand and the second band are colored a second color different from the first color; and adjacent colored blocks positioned on the face, wherein the left-hand block is colored the same as the first band and the hour hand, and the right-hand block is colored the same as the second hand and the minute hand in order to provide a visual association between the hour hand and the corresponding number contained within the first band representing an hour of the day, and between the minute hand and the corresponding number contained within the second band representing a minute of the day for enabling the user to determine the time in digital format.

2. The clock of claim 1 wherein a colon is positioned along the zero degree line with the adjacent blocks on either side of the colon.

3. The clock of claim 1 wherein the word "o'clock" is positioned vertically along the zero degree line.

4. The clock of claim 3 wherein the word "o'clock" is positioned between the sub-segments containing the integers zero and fifty-nine of the second set of numbers.

5. The clock of claim 1 further comprising:

a third set of numbers comprising consecutive integers one through twelve positioned radially about the center of the face a third distance from the center point;

wherein each number of the third set of numbers is positioned at a point along a boundary of one of the twelve segments; and wherein the integer twelve is positioned along the zero degree line, the integer one is positioned along the thirty degree line, and the remaining integers of the third set of numbers are arranged consecutively in a clockwise direction about the face at succeeding segment boundaries.

6. A clock useful for instruction in how to read time, comprising:

a face divided into twelve equally sized segments defined by boundary lines emanating from a center point;

a first set of numbers including integers one through twelve contained within a first band having twelve equally-sized segments having adjacent boundaries corresponding to the boundary lines emanating from the center point;

a second set of numbers including integers zero zero through fifty-nine contained within a second band having sixty equally-sized segments defined by adjacent boundaries;

an hour hand attached to the center point of the face and extending therefrom a distance to a point within the first band;

a minute hand attached to the face at the center point and extending therefrom a distance to a point within the second band;

wherein a boundary of one of the segments of the first band and one of the segments of the second band lies along a line extending vertically from the center point of the face to a top of the face;

wherein the segment of the first band proceeding in a clockwise direction from the line extending vertically from the center to the top of the face contains the integer twelve of the first set of numbers, and the succeeding segments in the first band each contain one of the remaining integers of the first set of numbers, arranged consecutively beginning with the integer one and proceeding in a clockwise direction about the face; and wherein the segment of the second band proceeding in a clockwise direction from the line extending vertically from the center to the top of the face contains the integer zero of the second set of numbers, and the succeeding segments in the second band each contain one of the remaining integers of the second set of numbers, arranged consecutively and proceeding in a clockwise direction about the face.

7. The clock of claim 6 wherein:

the first and second bands are colored differently;

the hour hand is the same color as the first band; and the minute hand is the same color as the second band.

8. The clock of claim 7 further comprising:

adjacent colored blocks separated by a colon and positioned on the face of the clock;

wherein the block to the left of the colon is colored the same as the band containing the first set of numbers, and the block to the right of the colon is colored the same as the band containing the second set of numbers enabling a user to associate a number indicated by the hour hand and contained within the first band with the block to the left of the colon, and to associate a number indicated by the minute hand and contained within the second band with the block to the right of the colon in order to read the time in digital format.

9. The clock of claim 8 wherein the colon is positioned along the line extending vertically from the center point of the face to the top of the face, with the adjacent blocks on either side of the colon.

10. The clock of claim 6 wherein the word "o'clock" is positioned vertically along the line extending vertically from the center point of the face to the top of the face.

11. The clock of claim 10 wherein the word "o'clock" is positioned between the sub-segments containing the integers zero and fifty-nine of the second set of numbers.

12. The clock of claim 6 further comprising:

a third set of numbers comprising consecutive integers one through twelve positioned radially about the center of the face;

wherein each number of the third set of numbers is positioned at a point along a boundary of one of the twelve segments; and wherein the integer twelve is positioned at the segment boundary extending vertically from the center point of the face to a top center point of the face, the integer one is positioned at the next succeeding boundary of the twelve segments, and the remaining integers of the third set of numbers are arranged consecutively in a clockwise direction about the face at the remaining boundaries of the twelve segments.

13. A system for determining the time on an analog clock, comprising:

a clock face including a first set of indicia, representing the hours of a day, positioned about the face a first distance from a center point of the face, wherein the first set of indicia is colored a first color;

a second set of indicia, representing the minutes of an hour, positioned about the face a second distance from the center point, wherein the second set of indicia is colored a second color;

an hour hand;

a minute hand; and a pair of adjacent bounded areas, wherein the left-hand area is colored the same as the first set of indicia and the right-hand area is colored the same as the second set of indicia enabling a user to make a visual color association between indicia representing a given hour of the day and the left-hand area, and between indicia representing a given minute of the day and the right-hand area.

14. The system of claim 13 wherein the shapes are separated by a colon.

* * * * *